US005996318A

United States Patent [19]

Draghetti

[11] Patent Number: 5,996,318

[45] Date of Patent: Dec. 7, 1999

[54] PACKET WRAPPING METHOD AND UNIT

[75] Inventor: Fiorenzo Draghetti, Medicina, Italy

[73] Assignee: G.D Societa ' per Azioni, Bologna, Italy

[21] Appl. No.: 09/005,142

[22] Filed: Jan. 9, 1998

[30] Foreign Application Priority Data

Jan. 10, 1997 [IT] Italy ..... B097A0011

[51] Int. Cl.[6] ..... B65B 19/22

[52] U.S. Cl. ..... 53/466; 53/234

[58] Field of Search ..... 53/466, 461, 228, 53/234, 233, 232, 225

[56] References Cited

U.S. PATENT DOCUMENTS

| | | | |
|---|---|---|---|
| 3,380,227 | 4/1968 | Youngman et al. | 53/234 X |
| 3,383,825 | 5/1968 | Titchenal et al. | 53/466 X |
| 3,439,473 | 4/1969 | Focke et al. | 53/234 |
| 3,527,014 | 9/1970 | Wahle et al. | 53/234 X |

FOREIGN PATENT DOCUMENTS

| | | |
|---|---|---|
| 0553636 A1 | 8/1993 | European Pat. Off. . |
| 1134500 | 12/1968 | United Kingdom . |

*Primary Examiner*—James F. Coan

*Attorney, Agent, or Firm*—Marshall, O'Toole, Gerstein, Murray & Borun

[57] ABSTRACT

A method and unit for wrapping packets of cigarettes, whereby a succession of packets is fed continuously along a wrapping path having a straight input portion and a substantially curved output portion substantially tangent to the input portion at a transfer station for transferring the packets; the input portion extends through a wrapping station where each packet engages a respective sheet of wrapping material, and folds the sheet into a U so that two end portions of the sheet project rearwards from the packet; and each packet, together with the respective sheet, is transferred, at the transfer station, from the input portion to the output portion so that the two end portions of the sheet are maintained projecting rearwards from the packet.

16 Claims, 5 Drawing Sheets

PACKET WRAPPING METHOD AND UNIT

BACKGROUND OF THE INVENTION

The present invention relates to a method of wrapping packets.

The present invention may be used to advantage on cigarette manufacturing machines, and in particular on packet cellophaning machines, to which the following description refers purely by way of example.

Packets of cigarettes are known to be wrapped in respective sheets of wrapping material using cellophaning machines by which the packets are fed continuously along a wrapping path, and which comprise a belt conveyor device and a wrapping conveyor device, in turn respectively comprising a straight conveyor belt and a wrapping wheel respectively defining a straight input portion and a circular output portion of the wrapping path.

Known cellophaning machines of the above type also comprise an intermediate transfer device interposed between the conveyor devices and in turn comprising a transfer wheel, which is tangent to the conveyor belt at a transfer station and to the wrapping wheel at a wrapping station, provides for receiving the packets from the conveyor belt and transferring them to the wrapping wheel, and defines a circular intermediate portion of the wrapping path.

The wrapping wheel normally comprises a number of folding seats, each of which comprises a peripheral opening facing radially outwards, and is supplied with a respective sheet of wrapping material over the peripheral opening, and with a respective packet which, as it is inserted inside the seat, engages and folds the sheet of wrapping material into a U.

The transfer wheel of cellophaning machines of the above type normally poses several drawbacks, both in terms of structure and operation: firstly, the cellophaning machine is structurally bulky and expensive to produce; and, secondly, each packet must be transferred at least twice before being wrapped, each of which transfer operations involves serious technical problems in the case of a continuously operating machine.

SUMMARY OF THE INVENTION

It is an object of the present invention to provide a method of wrapping packets, which not only provides for minimizing the number of transfer operations of the packets, but is also straightforward and cheap to implement.

According to the present invention, there is provided a method of wrapping packets, the method being characterized by comprising the step of continuously feeding a succession of packets in a given traveling direction and along a wrapping path comprising a substantially straight input portion and a substantially curved output portion, the input portion and the output portion being substantially tangent to each other at a transfer station; the step of feeding, for each packet, a sheet of wrapping material to a wrapping station located along said input portion and upstream from the transfer station in said traveling direction, each said sheet being positioned through the input portion in a position of interference with the respective packet; the step of folding each sheet into a U about the respective packet so that two portions of the sheet project rearwards from the packet; and a transfer step wherein each packet, together with the respective U-folded sheet, is transferred from the input portion to the output portion of said path at said transfer station.

The present invention also relates to a unit for wrapping packets.

According to the present invention, there is provided a unit for wrapping packets, the unit being characterized by comprising continuous conveying means for feeding a succession of packets in a given traveling direction and along a wrapping path comprising a substantially straight input portion and a substantially curved output portion substantially tangent to the input portion at a transfer station; supply means for feeding, for each packet, a sheet of wrapping material to a wrapping station located along the input portion of said path and upstream from said transfer station in said traveling direction; folding means for folding each sheet into a U about the respective packet so that, in use, two portions of the sheet project rearwards from the respective packet; and transfer means for transferring each packet, together with the respective U-folded sheet, from the input portion to the output portion of said path at said transfer station.

BRIEF DESCRIPTION OF THE DRAWINGS

Two non-limiting embodiments of the present invention will be described by way of example with reference to the accompanying drawings, in which.

DETAILED DESCRIPTION OF THE INVENTION

Figure 1:
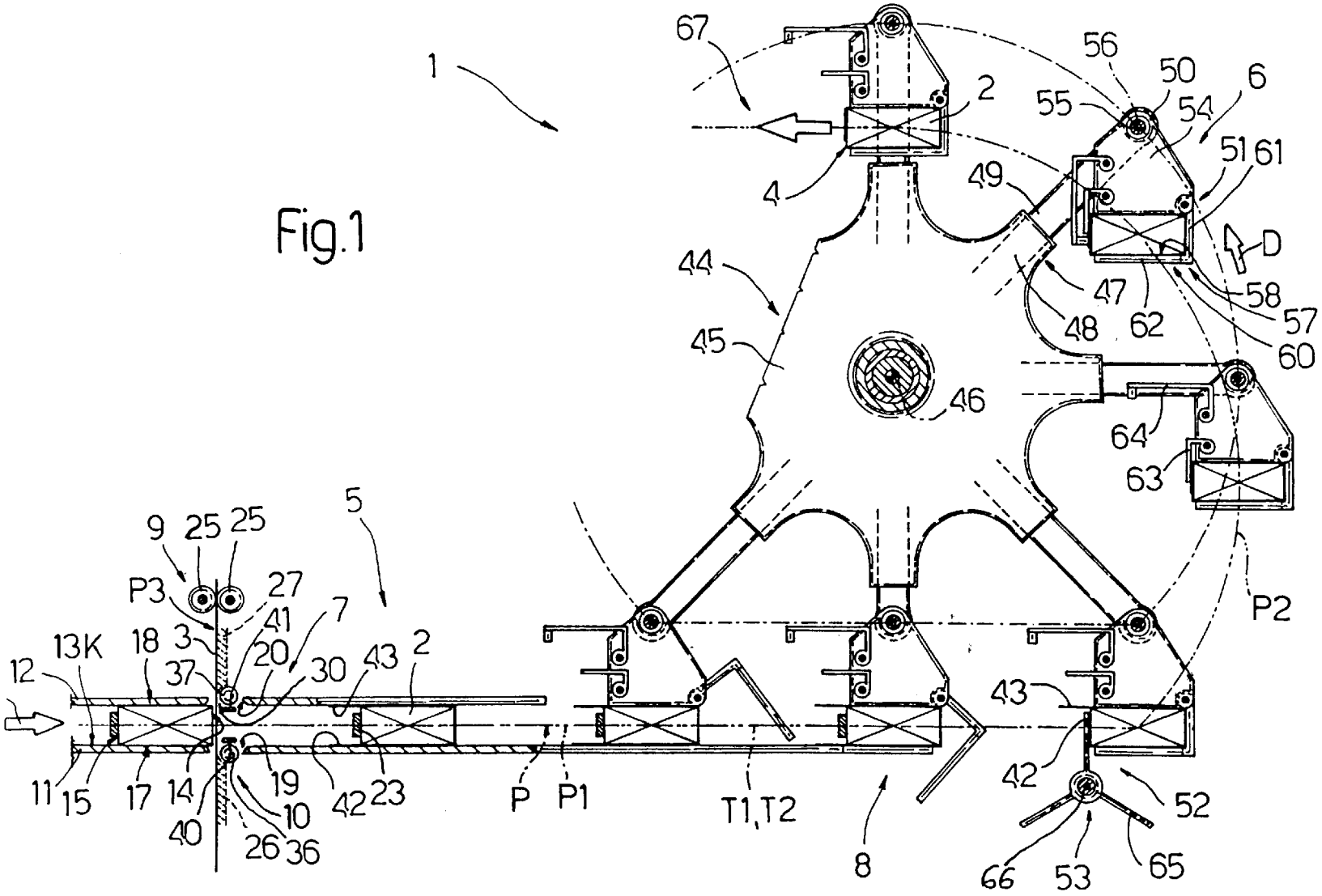
FIG. 1 shows a side view, with parts in section and parts removed for clarity, of a first preferred embodiment of a wrapping unit in accordance with the present invention.
Figure 7:
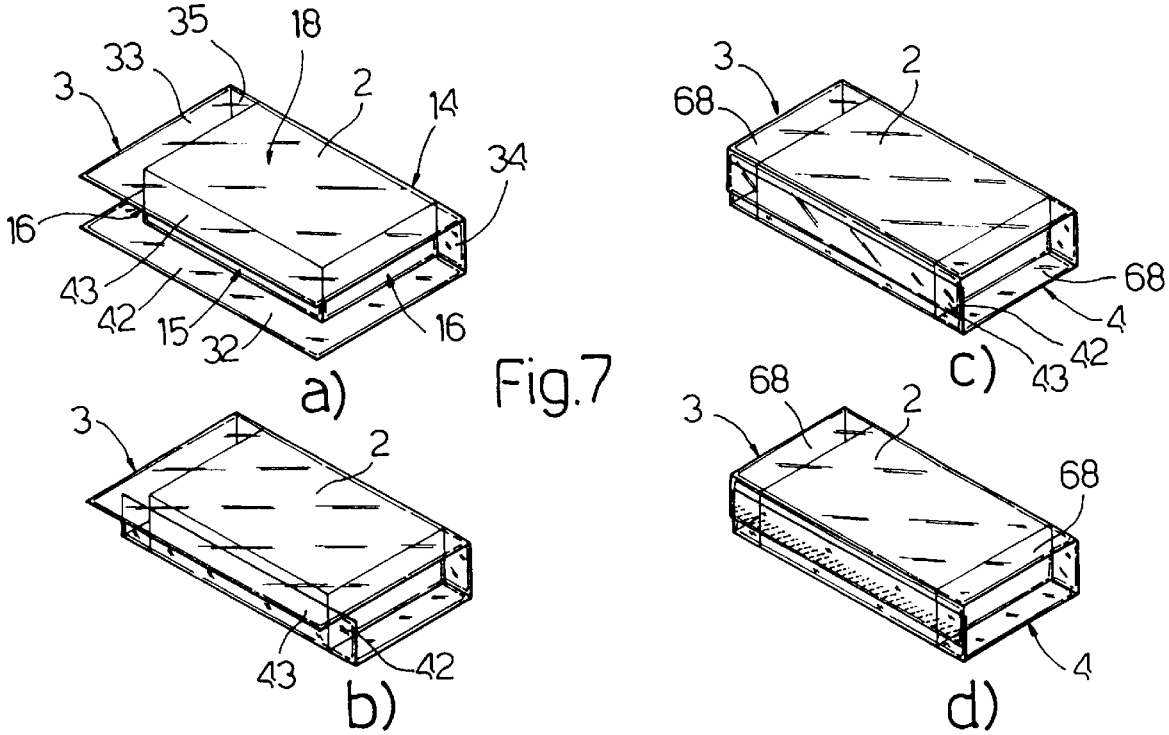
FIG. 7 shows a larger-scale view in perspective of four steps in the wrapping of a packet of cigarettes using the FIG. 1 unit.
Figure 4:
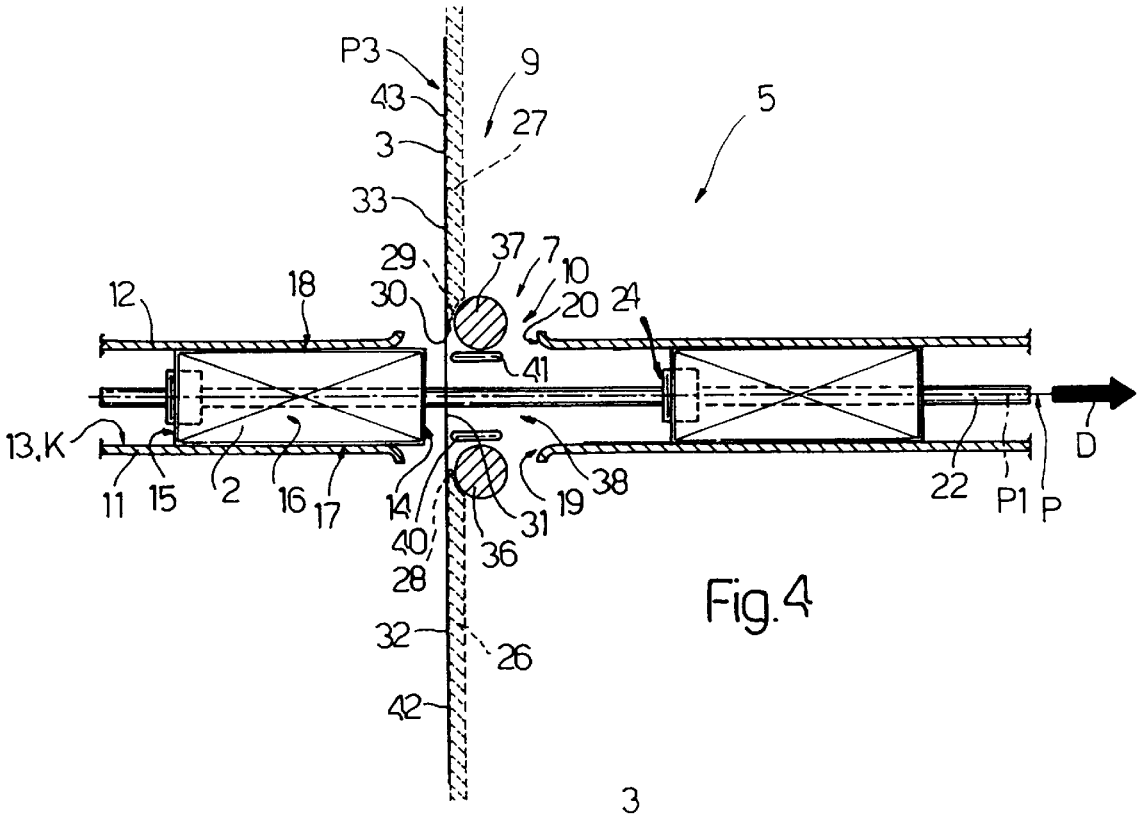
FIGS. 4, 5 and 6 show, with parts in section and parts removed for clarity, respective side, plan and front views of the FIG. 3 detail.
Figure 3:
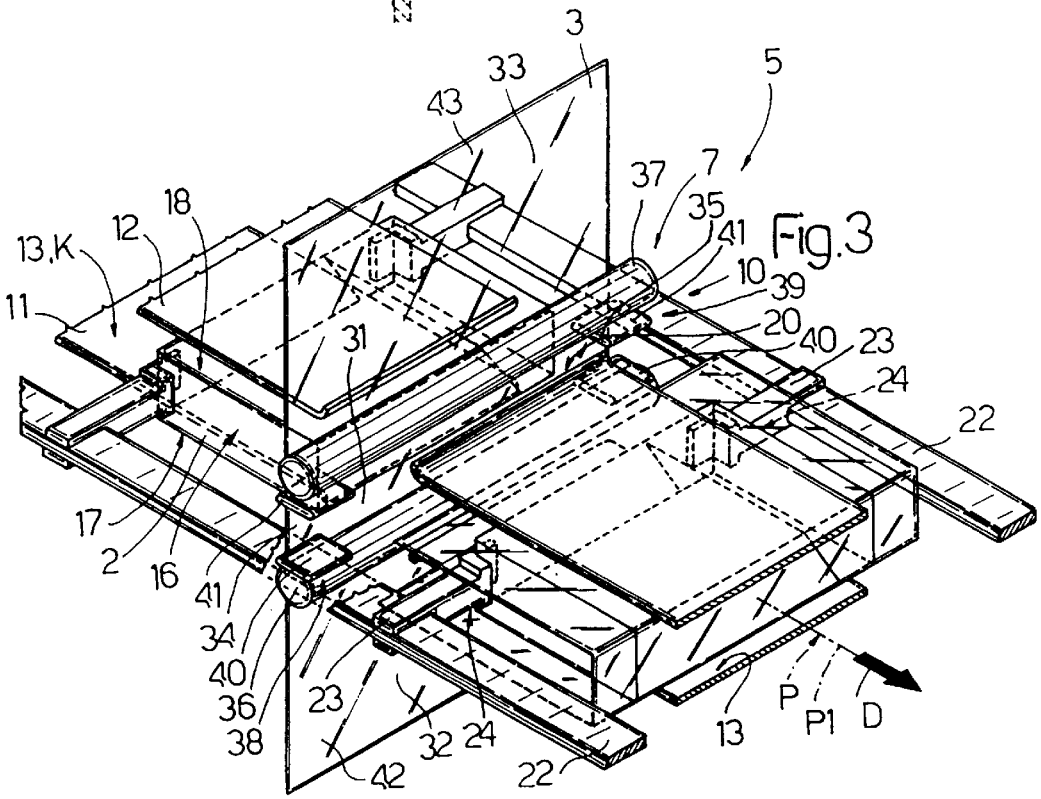
FIG. 3 shows a larger-scale view in perspective, with parts in section and parts removed for clarity, of a detail in FIG. 1.
Figure 5:
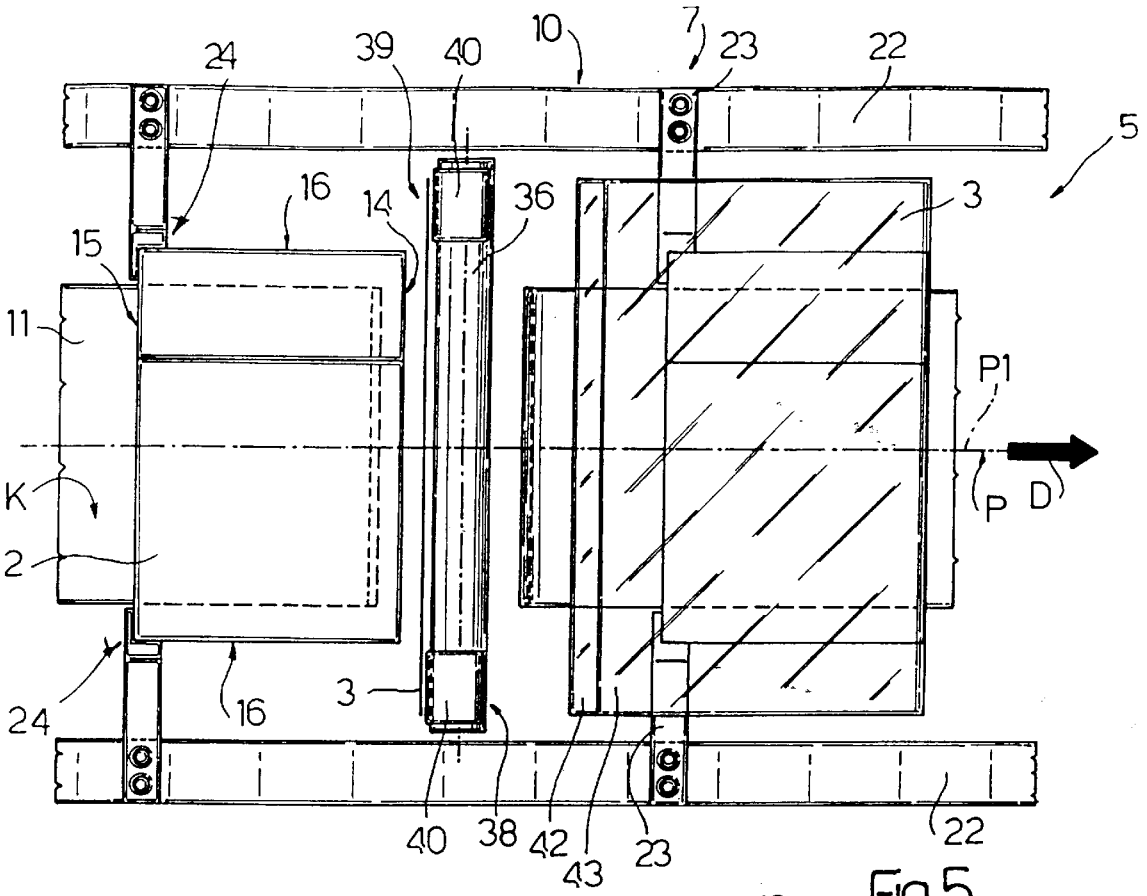
Figure 6:
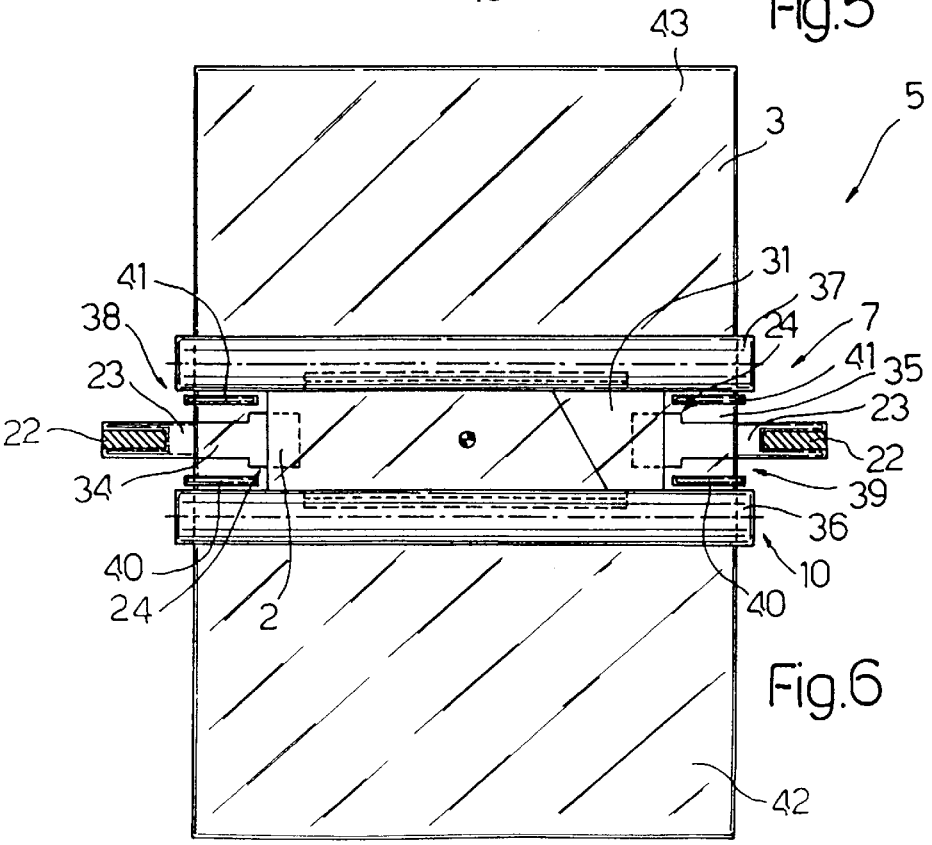

With reference to FIGS. 1 and 7, number 1 indicates a unit for wrapping packets 2 of cigarettes and for folding a sheet 3 of wrapping material about each packet 2 to form a tubular wrapping 4.

Unit 1 comprises a belt conveyor device 5 and a wheel conveyor device 6 for continuously feeding packets 2 in a given traveling direction D and along a wrapping path P comprising a straight input portion P1 defined by device 5 and extending through a wrapping station 7, and a substantially curved output portion P2 defined by device 6 and substantially tangent to portion P1 at a transfer station 8 downstream from station 7 along portion P1 in direction D.

More specifically, in the FIG. 1 embodiment, portions P1 and P2 respectively comprise, at station 8, a straight end portion T1 and a substantially straight initial portion T2, which extend through station 8 parallel to each other and to direction D, so as to bring devices 5 and 6 alongside each other and enable packets 2 to be transferred from portion P1 to portion P2.

As shown in FIGS. 3 to 6, unit 1 also comprises a supply device 9 located at wrapping station 7 and for feeding a sheet 3 of wrapping material to station 7 in time with each packet 2; and a folding device 10 located at station 7 and cooperating with device 5 to fold each sheet 3 into a U about respective packet 2 as packet 2 is fed along portion P1.

Conveyor device 5 comprises two straight plates 11 and 12 extending one over the other along portion P1, and defining a horizontal, open-sided feed channel 13, and a sliding surface K defining the bottom of channel 13 and on which packets 2 are placed flat with respective small lateral surfaces 14 and 15 facing respectively frontwards and rearwards in direction D, with respective end surfaces 16 parallel to direction D and outside channel 13, and with respective large lateral surface 17 and 18 substantially contacting respective plates 11 and 12. Plates 11 and 12 are smaller in width than the length of packets 2 measured crosswise to direction D, and are interrupted at station 7 by respective horizontal openings 19 and 20, which are smaller in width than packets 2 measured between surfaces 14 and 15 and parallel to direction D, and which enable device 9 to position sheets 3 through and crosswise to portion P1. Finally, bottom plate 11 extends along the whole of portion T1 to support packets 2 through transfer station 8, and comprises a comb-shaped end portion 21; whereas top plate 12 terminates upstream from portion T1 to enable device 6 to engage packets 2.

Device 5 also comprises two endless conveyor belts 22 extending on either side of channel 13, and each comprising a number of equally spaced push elements 23 aligned crosswise to direction D with respective elements 23 of the other belt 22. More specifically, elements 23 of belts 22 extend transversely from belts 22 towards one another inside channel 13 to engage at least the rear of packets 2 and feed packets 2 continuously along portion P1, and comprise, at the respective free ends, respective substantially L-shaped engaging heads 24 for engaging end surfaces 16 and rear lateral surfaces 15 of packets 2, leaving surfaces 17 and 18 clear.

Supply device 9 comprises two known rollers 25 substantially tangent to each other over openings 19 and 20, and for feeding sheets 3 to portion P1 along a path P3 crosswise to portion P1 and defined by two plates 26 and 27, which are located beneath rollers 25 and respectively beneath and over plates 11, 12 to guide and support sheets 3 in known manner through openings 19 and 20. More specifically, plates 26 and 27 respectively comprise a top edge 28 and a bottom edge 29 crosswise to direction D and defining an opening 30 crosswise to openings 19, 20 and facing channel 13, and cooperate with rollers 25 to position sheet 3 through portion P1 so that sheet 3 has a central portion 31 facing opening 30, two lateral portions 32 and 33 extending vertically downwards and upwards from portion 31 and contacting respective plates 26 and 27, and a further two lateral portions 34 and 35 extending horizontally from portion 31 and also facing opening 30.

Folding device 10 comprises two idle rollers 36 and 37 respectively supported in known manner beneath and over opening 30 and to the rear of respective plates 26 and 27 in direction D, and separated by a distance substantially equal to the thickness of packet 2; and two pairs 38 and 39 of plates 40, 41 positioned crosswise to direction D on either side of portion P1 and between rollers 36 and 37. More specifically, plates 40 of pairs 38 and 39 are substantially tangent to the opposite ends of roller 36, and are separated by a distance approximately equal to but no smaller than said length of packets 2, and approximately equal to but no greater than the width of sheets 3; whereas plates 41 of pairs 38 and 39 are positioned parallel to and directly facing respective plates 40, are separated from plates 40 by a distance permitting the passage of elements 23, and are substantially tangent to roller 37.

In actual use, each packet 2 is fed by respective elements 23 through station 7 so that the front small lateral surface 14 engages central portion 31 of respective sheet 3, and so that sheet 3 is pushed between rollers 36 and 37, which gradually engage portions 32 and 33 of sheet 3, and cooperate with packet 2 to fold sheet 3 into a U, so that portions 32 and 33 are folded onto respective surfaces 17 and 18, and respective transverse portions 42 and 43 project rearwards from the rear small lateral surface 15 of packet 2. As each sheet 3 is being folded into a U, pairs 38 and 39 of plates 40, 41 engage and partly fold respective portions 34 and 35 of sheet 3 towards respective surfaces 16 to prevent sheet 3 from sliding with respect to packet 2, i.e. to secure sheet 3 to packet 2.

Conveyor device 6 comprises a wheel 44, in turn comprising a powered central drum 45 mounted for rotation about a horizontal axis 46 crosswise to direction D, and a number of telescopic radial arms 47 of variable length, each of which is defined by a fixed portion 48 extending integrally from drum 45, and by a movable portion 49 fitted in radially sliding manner to respective fixed portion 48 and connected at the free end 50 to a known first positive control device (not shown) for varying the length of respective arm 47 as wheel 44 is rotated.

For each arm 47, device 6 also comprises a respective transfer and wrapping unit 51, which is fitted to the free end 50 of arm 47, and is fed continuously by wheel 44 along portion P2 of path P to pick up a respective packet 2 together with respective U-folded sheet 3 at transfer station 8, and to feed packet 2 through a folding station 52 located along portion P2, downstream from station 8 in direction D, and where portion 42, located radially outwards of wheel 44 with respect to portion 43, is folded squarely onto surface 15 of packet 2 by a folding device 53.

Figure 2:
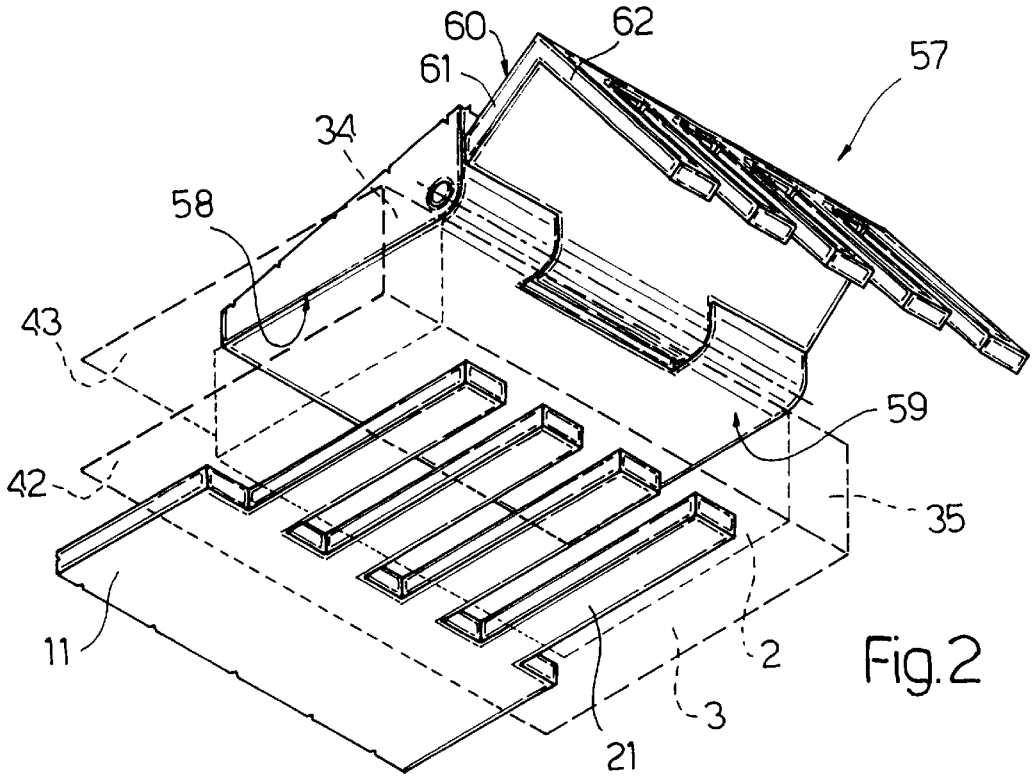
FIG. 2 shows a larger-scale view in perspective, with parts in section and parts removed for clarity, of a detail in FIG. 1.

Each transfer unit 51 comprises a prismatic supporting body 54, the top end of which is connected in rotary manner to respective end 50 by a hinge 55 having an axis 56 parallel to axis 46 and permitting rotation of body 54 with respect to arm 47 by a known second positive control device (not shown); and a retaining device 57, in turn comprising a seat 58 for receiving and feeding a respective packet 2 along portion P2 with rear portions 42 and 43 projecting outwards of seat 58, and which is defined by a bottom surface 59 of body 54 and, as shown more clearly in FIG. 2, by a substantially L-shaped wall 60 mounted for rotation with respect to body 54 by a known third positive control device (not shown).

More specifically, wall 60 comprises a first portion 61 hinged to body 54 and of a length substantially equal to the thickness of packet 2; and a comb-shaped second portion 62 connected crosswise to portion 61 and of a length substantially equal to the width of packet 2. At least along portion T2 of portion P2, wall 60 is movable between a loading position in which wall 60 is completely detached from surface 59 and seat 58 is open to receive a respective packet 2, and a retaining position in which portion 62 is parallel to surface 59, and seat 58 is substantially closed about packet 2 and is U-shaped to enable portions 42 and 43 of respective sheet 3, as stated, to project rearwards from seat 58 in the traveling direction of unit 51.

Each unit 51 also comprises a respective folding plate 63 fitted in rotary manner to body 54, on the opposite side to wall 60, and for folding portion 43 squarely onto portion 42 to form wrapping 4; and a sealing device 64 fitted in rotary manner to body 54, on the same side as plate 63, and for contacting and sealing superimposed portions 42 and 43 to each other. More specifically, both folding plate 63 and sealing device 64 are activated by a known fourth positive control device (not shown), which cooperates with the other said positive control devices to form wrappings 4 as packets 2 are fed along portion P2.

Finally, folding device 53 is located outwards of the periphery of wheel 44 at folding station 52, and comprises a number of arms 65, each of which rotates about a common axis 66 to engage and fold a respective portion 42 squarely onto respective packet 2, and more specifically onto the small lateral surface 15 facing outwards of respective seat 58.

Operation of unit 1 will now be described with reference to one packet 2 and respective sheet 3 of wrapping material, and as of the instant in which sheet 3 has been supplied and positioned, as stated, by supply device 9 at station 7.

As sheet 3 is positioned facing opening 30, packet 2 is pushed by elements 23 of device 5 along portion P1 of path P at a given speed V1, and is fed through station 7 and opening 30 so that front lateral surface 14 encounters central portion 31 of sheet 3 to detach sheet 3 from plates 26 and 27 and force it between rollers 36 and 37. At the same time sheet 3 is fed and folded into a U between rollers 36 and 37, plates 40 and 41 partially fold lateral portions 34 and 35 towards end surfaces 16 to prevent sheet 3 from sliding with respect to packet 2; and, by the time packet 2 has been fed completely between rollers 36 and 37 and is once more positioned between plates 11 and 12, sheet 3 is folded into a U with portions 42 and 43 projecting rearwards with respect to rear small lateral surface 15 of packet 2, and with lateral portions 34 and 35 again substantially coplanar with surface 14.

At this point, elements 23 feed packet 2 along portion T1, and, at the same time, a transfer unit 51 is fed by wheel 44 along portion T2 in time with packet 2, and is positioned by said positive control devices (not shown) with bottom surface 59 parallel to surface K, and with wall 60 in the loading position. As the first positive control device slides portion 49 of arm 47 with respect to portion 48 to shorten arm 47, wheel 44 feeds unit 51 along portion T2 at speed V1, and positions unit 51 with surface 59 on top of packet 2; and, once packet 2 reaches comb-shaped end portion 21 of plate 11, the second positive control device moves wall 60 into the retaining position, in which comb-shaped portion 62 momentarily engages portion 21 to retain packet 2 inside seat 58.

Along portions T1 and T2, unit 51 and packet 2 are fed by respective devices 6 and 5 at the same speed V1, and the first positive control device gradually adjusts the length of arm 47 so that the axis of rotation 56 of body 54 and body 54 itself accompany packet 2 instant by instant along portion T2. Once packet 2 is retained inside seat 58, wheel 44 feeds unit 51 through station 52 where one of arms 65 of device 53 engages and folds portion 42 onto surface 15 of packet 2. Subsequently, plate 63 folds portion 43 squarely onto portion 42, and keeps portions 42 and 43 pressed one on top of the other until they are sealed together by device 64.

Once tubular wrapping 4 is formed, wheel 44 feeds packet 2 to an unloading station 67 located along portion P2, downstream from station 52 in direction D, and where packet 2 is fed to a known wrapping device (not shown) by which two opposite annular end portions 68 of tubular wrapping 4 projecting longitudinally from packet 2 with respect to respective end surfaces 16 are folded to complete the folding of wrapping 4.

According to a variation not shown, conveyor device 6 comprises a further folding device located between stations 52 and 67, and for folding portions 68 of each wrapping 4 in known manner before packet 2 is unloaded off wheel 44.

Figure 8:
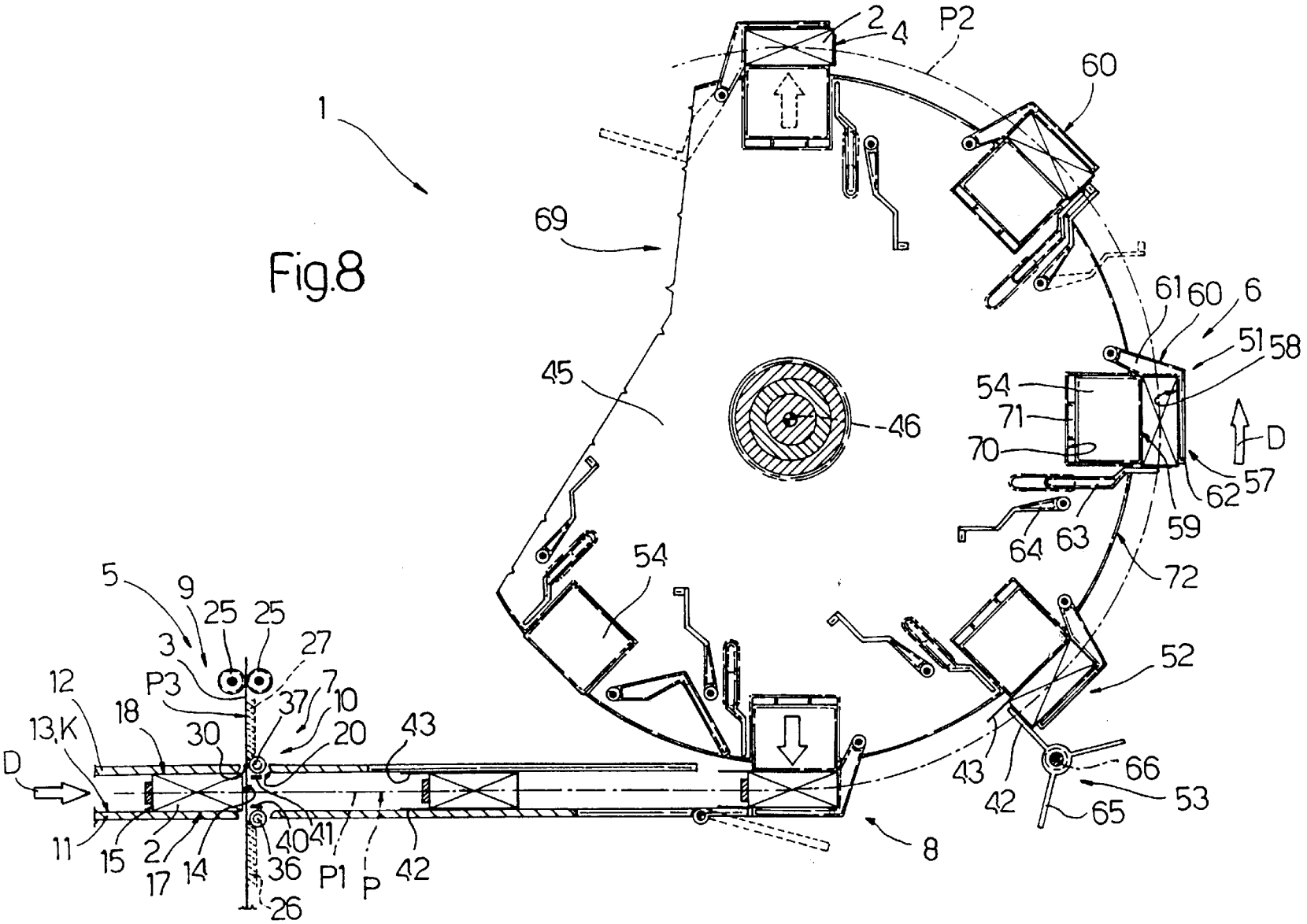
FIG. 8 shows a side view, with parts in section and parts removed for clarity, of a second preferred embodiment of the FIG. 1 unit.

The FIG. 8 embodiment comprises a wheel 69 substantially similar to wheel 44, but which provides for feeding units 51 along a circular portion P2 tangent to portion P1 at only one point at station 8, and by which units 51 are fed through station 8 in time with respective packets 2, so that packets 2 are transferred from device 5 to device 6 as soon as surface 59 of each unit 51 contacts respective packet 2 at comb-shaped end portion 21 of plate 11.

More specifically, body 54 of each unit 51 is mounted so as to slide radially inside a respective seat 70 formed along the periphery of drum 45, and is connected to said first positive control device by an arm 71 for moving body 54 between a withdrawn position inside seat 70, in which surface 59 is substantially flush with a cylindrical outer surface 72 of drum 45, and a partly extracted position in which surface 59 substantially projects with respect to surface 72. Moreover, wall 60 is fitted in rotary manner to drum 45 itself, and is activated synchronously with body 54 so as to close about respective packet 2 the instant packet 2 is contacted by surface 59.

Unit 1 operates in the same way with wheel 69 as with wheel 44, except that, as opposed to being transferred along portions T1 and T2, i.e. along a straight portion of path P, each packet 2 is transferred from device 5 to device 6 at a given precise instant at comb-shaped end portion 21 of plate 11. Also, since bodies 54 of units 51 are no longer mounted for rotation with respect to drum 45, packets 2 are fed along portion P2 with respective portions 42 and 43 extending rearwards at all times in the traveling direction of packets 2.

I claim:

1. A method of wrapping packets, wherein the method comprises the step of continuously feeding a succession of packets (2) in a given traveling direction (D) and along a wrapping path (P) comprising a substantially straight input portion (P1) and a substantially curved output portion (P2), the input portion (P1) and the output portion (P2) being substantially tangent to each other at a transfer station (8); the step of feeding, for each packet (2), a sheet (3) of wrapping material to a wrapping station (7) located along said input portion (P1) and upstream from the transfer station (8) in said traveling direction (D), each said sheet (3) being positioned through the input portion (P1) in a position of interference with the respective packet (2); the step of folding each sheet (3) into a U about the respective packet (2) so that two portions (42, 43) of the sheet (3) project rearwards from the packet (2); and a transfer step wherein each packet (2), together with the respective U-folded sheet (3), is transferred from the input portion (P1) to the output portion (P2) of said path (P) at said transfer station (8); said transfer step comprises the substeps of feeding the packets (2) and respective sheets (3) onto respective transfer units (51) traveling along said output portion (P2) and through said transfer station (8) in time with the respective packets (2), each transfer unit (51) comprising a respective seat (58) movable between a loading and retaining position in said transfer station for housing the respective packet (2) together with the respective sheet (3); and retaining the respective packet (2) inside each seat (58) by means of retaining means (57) associated with each said transfer unit (51); the packet (2) being so positioned inside the respective seat (58) that said portions (42, 43) of the respective sheet (3) project outwards of the seat (58).

2. A method as claimed in claim 1, characterized by comprising the further step of folding said two portions (42, 43) one on top of the other to form a respective tubular wrapping (4) about the packet (2) as the packet (2) is fed along the output portion (P2) of said path (P).

3. A method as claimed in claim 2, characterized by comprising the step of sealing said two portions (42, 43) to each other as the packet (2) is fed along the output portion (P2) of said path (P).

4. A method as claimed in claim 1, characterized in that each packet (2) is fed along the input portion (P1) of said path (P) by continuous feeding means (5) extending along the input portion (P1); each packet (2) lying flat along the input portion (P1), and being engaged by said feeding means (5) at least at the rear with respect to said traveling direction (D).

5. A method as claimed in claim 1, characterized in that said retaining means (57) comprise a first and a second retaining element (59, 60); the first retaining element (59) defining a fixed surface (59) of the respective seat (58); and the second retaining element (60) defining at least one movable wall (60) of the seat (58), and being movable between a receiving position, in which the seat (58) receives a respective packet (2), and a retaining position.

6. A method as claimed in claim 5, characterized in that said transfer station (8) comprises an end portion (T1) of said input portion (P1), and an initial portion (T2) of said output portion (P2); said end and initial portions (T1, T2) being substantially parallel to each other; and said movable wall (60) moving gradually from the receiving position to the retaining position at least along said end and initial portions (T1, T2).

7. A method as claimed in claim 5, characterized in that said output portion (P2) is a circular output portion tangent to the input portion (P1) at said transfer station (8); said retaining means (57) moving substantially instantaneously between the receiving position and the retaining position at a point of tangency between the input portion (P1) and the output portion (P2) of said path (P).

8. A method as claimed in claim 4, characterized in that said step of folding each sheet (3) into a U about the respective packet (2) comprises the substeps of each packet (2) engaging the respective sheet (3) at a substantially central portion (31) of the sheet (3), the sheet (3) having two lateral portions (34, 35) projecting laterally on opposite sides of the central portion (31); and engaging at least one of said two lateral portions (34; 35) by means of engaging means (40, 41) located at said wrapping station (7), to partially fold the lateral portion (34; 35) towards the respective packet (2) as the packet (2) is fed through the wrapping station (7).

9. A unit for wrapping packets, the unit being characterized by comprising continuous conveying means (5, 6) for feeding a succession of packets (2) in a given traveling direction (D) and along a wrapping path (P) comprising a substantially straight input portion (P1) and a substantially curved output portion (P2) substantially tangent to the input portion (P1) at a transfer station (8); supply means (9) for feeding, for each packet (2), a sheet (3) of wrapping material to a wrapping station (7) located along the input portion (P1) of said path (P) and upstream from said transfer station (8) in said traveling direction (D); folding means (10) for folding each sheet (3) into a U about the respective packet (2) so that, in use, two portions (42, 43) of the sheet (3) project rearwards from the respective packet (2); and transfer means (51) for transferring each packet (2), together with the respective U-folded sheet (3), from the input portion (P1) to the output portion (P2) of said path (P) at said transfer station (8); said transfer means (51) comprise a number of transfer units (51) traveling continuously along the output portion (P2) of said path (P), and each traveling through said transfer station (8) in time with the respective packet (2) to pick up the packet (2) together with the respective sheet (3); each transfer unit (51) comprising a respective seat (58) movable between a receiving and retaining position in said transfer station (8) for housing the respective packet (2) together with the respective sheet (3), and retaining means (57) for retaining the packet (2) inside the respective seat (58) so that said portions (42, 43) of the respective sheet (3) project, in use, outwards from the seat (58).

10. A unit as claimed in claim 9, characterized in that said conveying means (5, 6) comprise continuous feeding means (5) extending along the input portion (P1) of said path (P) to feed each packet (2) along the input portion (P1); said feeding means (5) comprising engaging means (23) for engaging each packet (2) at least at the rear with respect to said traveling direction (D).

11. A unit as claimed in claim 9, characterized by comprising further folding means (53, 63) for folding said two portions (42, 43) one on top of the other to form a tubular wrapping (4) about the packet (2).

12. A unit as claimed in claim 11, characterized by comprising joining means (64) for sealing said two portions (42, 43) to each other.

13. A unit as claimed in claim 10, characterized in that said folding means (10) are located at said wrapping station (7), and comprise two folding elements (36, 37) located beneath and over the input portion (P1) of said path (P) to fold respective first lateral portions (32, 33) of each sheet (3) as the packet (2) is fed, in use, between the folding elements (36, 37), said first lateral portions (32, 33) extending from a central portion (31) of the sheet (3) also having two second lateral portions (34, 35); and two engaging elements (40, 41) located on opposite sides of the input portion (P1) to engage at least one of said two second lateral portions (34; 35) and partially fold the second lateral portion (34; 35) towards the respective packet (2) as the packet (2) is fed, in use, between said folding elements.

14. A unit as claimed in claim 9, characterized in that said retaining means (57) comprise a first and a second retaining element (59, 60); the first retaining element (59) defining a fixed surface (59) of the respective seat (58); and the second retaining element (60) defining at least one movable wall (60) of the seat (58), and being movable between a receiving position, in which the seat (58) receives a respective packet (2), and a retaining position.

15. A unit as claimed in claim 14, characterized in that said transfer station (8) comprises an end portion (T1) of said input portion (P1), and an initial portion (T2) of said output portion (P2); said end and initial portions (T1, T2) being substantially parallel to each other; and said retaining means (57) moving gradually from the receiving position to the retaining position at least along said end and initial portions (T1, T2).

16. A unit as claimed in claim 14, characterized in that said output portion (P2) is a circular output portion (P2) tangent to the input portion (P1) at said transfer station (8); said retaining means (57) moving substantially instantaneously between the receiving position and the retaining position at a point of tangency between the input portion (P1) and the output portion (P2) of said path (P).

* * * * *